US006905090B1

(12) United States Patent
Mäkinen et al.

(10) Patent No.: US 6,905,090 B1
(45) Date of Patent: Jun. 14, 2005

(54) METHOD AND DEVICE IN CONNECTION WITH A REEL-UP

(75) Inventors: Risto Mäkinen, Mäntsälä (FI); Petri Enwald, Tuusula (FI); Janne Veräjänkorva, Espoo (FI)

(73) Assignee: Metso Paper, Inc., Helsinki (FI)

( * ) Notice: Subject to any disclaimer, the term of this patent is extended or adjusted under 35 U.S.C. 154(b) by 328 days.

(21) Appl. No.: 10/018,702

(22) PCT Filed: Jun. 6, 2000

(86) PCT No.: PCT/FI00/00501

§ 371 (c)(1),
(2), (4) Date: Dec. 13, 2001

(87) PCT Pub. No.: WO01/00515

PCT Pub. Date: Jan. 4, 2001

(30) Foreign Application Priority Data

Jun. 24, 1999 (FI) ..... 991450

(51) Int. Cl.[7] ..... B65H 18/26
(52) U.S. Cl. ..... 242/547; 242/541; 242/542.3
(58) Field of Search ..... 242/547, 542.3, 242/541

(56) References Cited

U.S. PATENT DOCUMENTS 3,328,990 A * 7/1967 Sieger ..... 242/547
3,471,097 A * 10/1969 Phelps ..... 242/541.3
4,491,283 A * 1/1985 Pav et al. ..... 242/547
4,778,119 A 10/1988 Yamazaki et al.
4,964,587 A * 10/1990 Oki et al. ..... 242/541.1
5,360,179 A 11/1994 Vesterinen et al. ..... 242/526.3
5,765,462 A 6/1998 Mannio ..... 83/639.5
5,779,183 A 7/1998 Aalto et al. ..... 242/547
5,895,007 A 4/1999 Moller et al. ..... 242/527.2
6,427,938 B1 * 8/2002 Madrzak et al. ..... 242/526.3

* cited by examiner

*Primary Examiner*—William A. Rivera
(74) *Attorney, Agent, or Firm*—Steinberg & Raskin, P.C.

(57) ABSTRACT

In the method and device in connection with a reel-up of a paper web there is a rotating reel spool (2) around which a reel (R) has been formed from the paper web (W) passed to the reel-up. In the method web (W) passed to the reel is cut, and the surface layers of the reel are bound by a pressing device (3) which is in contact with the surface of the rotating reel (R) and has a press member (3*b*) forming a nip with the peripheral surface of the reel and rotating substantially at the same surface speed therewith. In addition to using the press member (3*b*), the final end, i.e. tail (H) of the web that travels along with the rotating motion of the reel is guided against the peripheral surface of the reel (R) by a guiding member (3*a*), which is located within a distance from the press member (3*b*) in the direction of the perimeter of the reel and whose surface that is located opposite to the reel has a lower speed in the direction of motion of the peripheral surface of the reel than the peripheral surface of the reel (R).

21 Claims, 3 Drawing Sheets

METHOD AND DEVICE IN CONNECTION WITH A REEL-UP

FIELD OF THE INVENTION

The invention relates to a method according to the preamble of the appended claim 1 in connection with a reel-up. The invention also relates to a device in connection with the reel-up, the device being of the presented in the preamble of the appended claim 8.

BACKGROUND OF THE INVENTION

By means of a continuous reel-up a continuous paper web, typically of several meters wide, passed from a paper machine or finishing machine for paper, is reeled to form machine reels. To implement the reeling in a continuous manner, a reel change has to be conducted at fixed intervals, so that when the preceding machine reel becomes full, the web is guided to travel to a new reel spool forming the core of the next machine reel.

In the reeling station, when the reel to be reeled becomes full, the web is cut by means of a suitable method which depends e.g. on the grammage of the web, and the new end of the web following the cutting point it guided around a new empty reel spool which has been brought to a change position from a reel spool storage at an earlier stage. There are a number of patents and patent applications related to this change sequence or a part of the same. The Finnish patent 95683 of the applicant, the corresponding international publication WO 93/34495 and U.S. Pat. No. 5,779,183 disclose a press device by means of which the access of air underneath the web entering the reel is prevented. The Finnish patent application 915432 of the applicant, as well as the corresponding U.S. Pat. No. 5,360,179, in turn, disclose different ways of cutting the web in connection with the reel change. The Finnish patent 97339 of the applicant and the corresponding EP application publication 739695 and the U.S. Pat. No. 5,765,462 disclose a blade cutting device that cuts the web. Furthermore, the Finnish patent 100590 of the applicant discloses a manner in which the web can be cut in full-width by means of a striking cutting blade, and the new end of the web can be blown on a new empty reel spool by means of an air blowing.

It is known to move the aforementioned press device in which a brush or a roll functions as a contact member, to a loading contact with a surface of the reel, substantially the lower surface of the reel, in the end phase of the reeling process, and the press device is conveyed in loading contact with the full reel when the reel is transferred to a change position. By means of press devices of prior art it has been possible to prevent the access of air in the reel, and thereby the slackening of the surface layers of the machine reels.

However, especially when the running speeds exceed 25 m/s, problems are caused by the behaviour of the "tail " remaining topmost in the machine reel after the cutting.

When a brush-like member is used as a contact member in the press device, the bristles of which are in contact with the surface of the machine reel, problems are caused by the insufficient linear load in the contact point. The contact of the brush and the paper produces dust. Furthermore, the dragging force caused by the brush causes a change in the web tension in connection with the reel change.

The press roll used as a contact member keeps the reel well in its form, and it does not produce dust. When the tail meets the press device it is not in contact with the surface of the reel, and it hits the press device thus causing a strong pull in the paper, wherein pieces of paper are torn off. The press roll presses these loose pieces on the surface of the paper reel, and these pieces travel along with the rotating motion of the reel to the upper sector of the reel, wherefrom they may drift in the nip between the new, initiated reel and the reeling cylinder, thereby ending up inside the new reel and causing broke and problems at the next stage of the process, especially in a supercalender or a corresponding multinip calender.

OBJECTS AND SUMMARY OF THE INVENTION

One purpose of the present invention is to introduce a method in connection with the reel change, by means of which the above-presented drawbacks of the solutions of prior art can be eliminated to a large degree, thus improving the state of the art in the field. To attain this purpose, the method according to the invention is primarily characterized in what will be presented in the characterizing part of the appended claim 1. The device according to the invention, in turn, is characterized in what will be presented in the characterizing part of the appended claim 8. The method is characterized in that the reel and/or the tail which is not in contact with the reel or tends to loosen from the same are/is controlled at two distinct points on the perimeter of the reel: control of the outer surface layers of the reel by means of a press roll producing the loading and control of the tail by means of a separate guiding member which applies a smaller load to the reel and whose surface speed differs substantially from the surface speed of the peripheral surface of the reel. The latter member is primarily used for controlling the tail. by guiding it towards the reel and/or by wiping off the pieces detached from the tail before they are conveyed to the upper half of the reel wherefrom they could again end up in the closing reeling nip. The device is characterized by the combination of the press roll of the reel and the guiding member of the tail.

DESCRIPTION OF THE DRAWINGS

In the following description the invention will be described in more detail with reference to the appended drawings. In the drawings

DETAILED DESCRIPTION OF THE INVENTION

Figure 1:
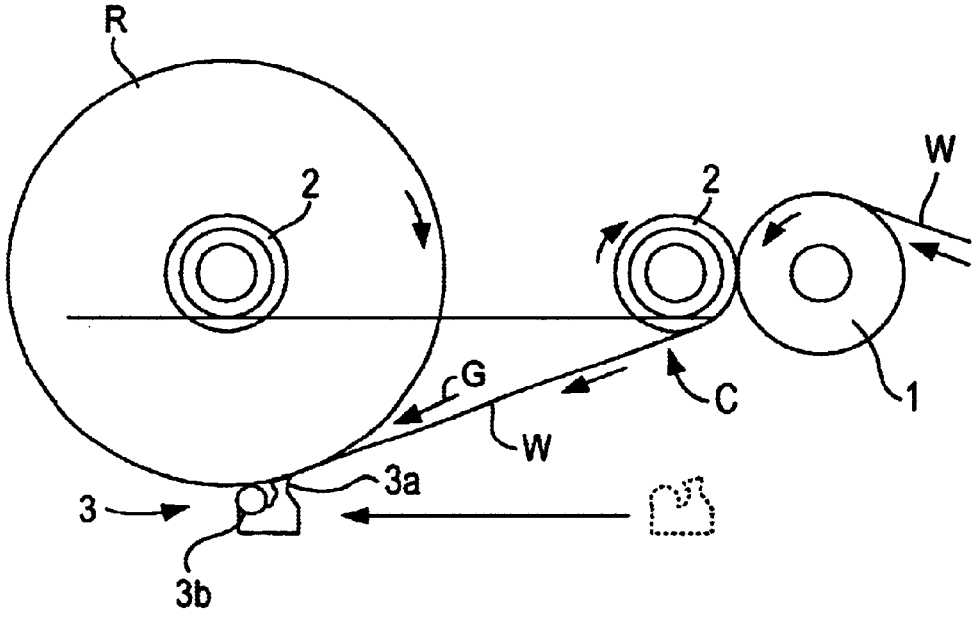
FIG. 1 shows a side-view of a situation in the reel-up of a paper web before the cutting of the web.

FIG. 1 shows a reel-up for paper web known as such, in which reel-up the method and the device are applied. Said reel-up is a continuous reel-up which reels successive machine reels R around reel spools 2 from a continuous paper web W passed from a paper machine or finishing machine for paper. During the reeling, the reel spools 2 are supported at the ends by means of a suitable supporting structure, such as reeling rails. During the reeling, the machine reels are rotated with a centre-rive of their own. FIG. 1 shows a situation in which, to implement the reel change, the machine reel R that has become full is taken away from the reeling cylinder 1 by means of reeling carriages which are in contact with the ends of the reel spool 2, via which reeling cylinder the paper web W has been passed to the reel through a reeling nip between the reel and the cylinder 1. The narrowing gap between the incoming run of the web and the outer surface of the reel, via which gap air tends to intrude into the reel, is marked with an arrow G. Furthermore, FIG. 1 shows how the new reel spool 2 is brought in contact with the web W travelling on the surface of the reeling cylinder 1 to conduct the change.

FIG. 1 also shows a press device 3, which in the situation of FIG. 1 is used for preventing the access of air via the gap G underneath the web in the reel. In a situation where the reel R is becoming full, but is still in contact with the reeling cylinder via the reeling nip, the press device 3 has been brought in loading contact with the surface of the reel R, and it is transferred forward together with the reel to the change position of FIG. 1, out of contact with the reeling cylinder 1*a*. Solutions for transferring the press device 3 in contact with the reel and forward together with the reel, are not described in more detail. Thereafter the web is cut at the point marked with arrow C for example with a full-width blade cutting device or by means of change blowing, whereafter the new end of the web is guided around a new reel spool 2.

Figure 2:
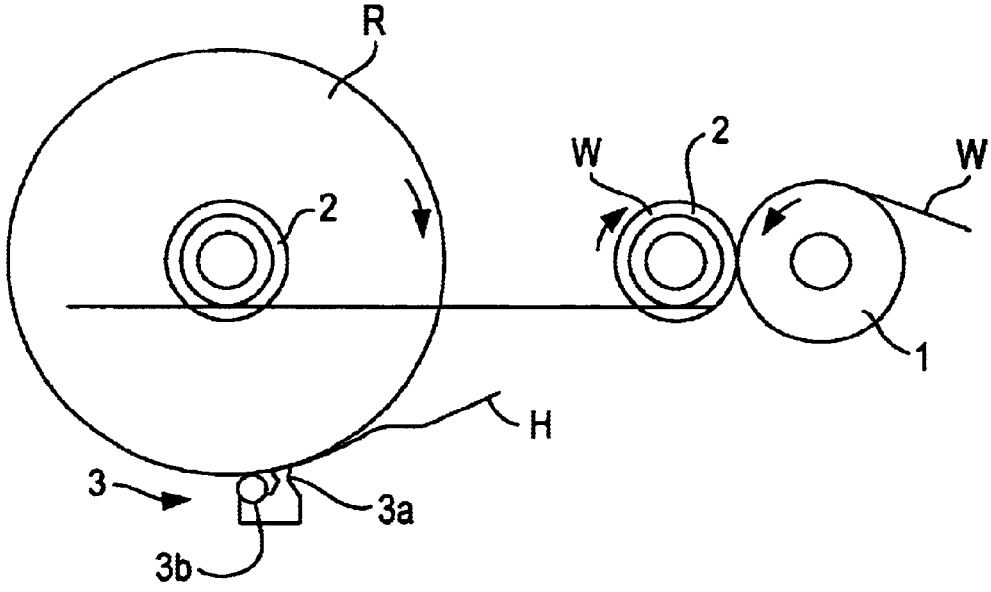
FIG. 2 shows a side-view of a situation in the reel-up of a paper web after the cutting of the web.

FIG. 2 shows a situation after the cutting. The free final end of the web that constitutes the last section of the web passed to the reel forms a tail H, which tends to get loose from the reel R. After the cutting the deceleration of the speed of rotation of the reel R also begins, for example by means-of the centre-drive of the reel spool forming the core of the reel. In the direction of rotation of the reel R the press device 3 comprises first a guiding member 3*a*, the purpose of which is primarily to guide the tail of the cut web W closer to the peripheral surface of the reel or against the peripheral surface of the reel, and a member which is loaded against the surface of the reel with a particular force and which rotates at the same surface speed as the reel, forming a nip with the peripheral surface of the reel. Such a member can be composed of a press roll 3*b* journalled for free rotation. The guiding member 3*a* is not necessarily in contact with the surface layers of the reel, and if it is in contact with them, it lies, in any case, against the peripheral surface of the reel with a lower force than the press roll 3*b* following the guiding member 3*a* and preventing the access of air from the gap G to the reel in the situation of FIG. 1, and binding the surface layers of the reel in the situation of FIG. 2 to keep them together especially when the speed of rotation of the reel is reduced.

The guiding member 3*a* is located within the area of the lower half of the reel and it is used for guiding the travel of the tail H forming the final section of the cut web W. The guiding member 3*a* is preferably located in the vicinity of the lowest point of the reel, for example in the sector of ±45° therefrom. The press roll 3*b* is located within a short distance after the guiding member 3*a*. The distance is such that it is not possible for the tail to substantially loosen itself from the surface of the reel. The distance, when measured along the perimeter of the reel is advantageously approximately smaller than a ¼ of the diameter of the reel, in other words in degrees approximately under 30°.

The free tail H revolves during several laps around the rotation axis of the reel on the perimeter of the reel R along with the rotating motion of the reel during several revolutions, and the guiding member 3*a* is used for controlling the behaviour of the tail H advantageously during several revolutions after the cutting of the web.

Figure 3:
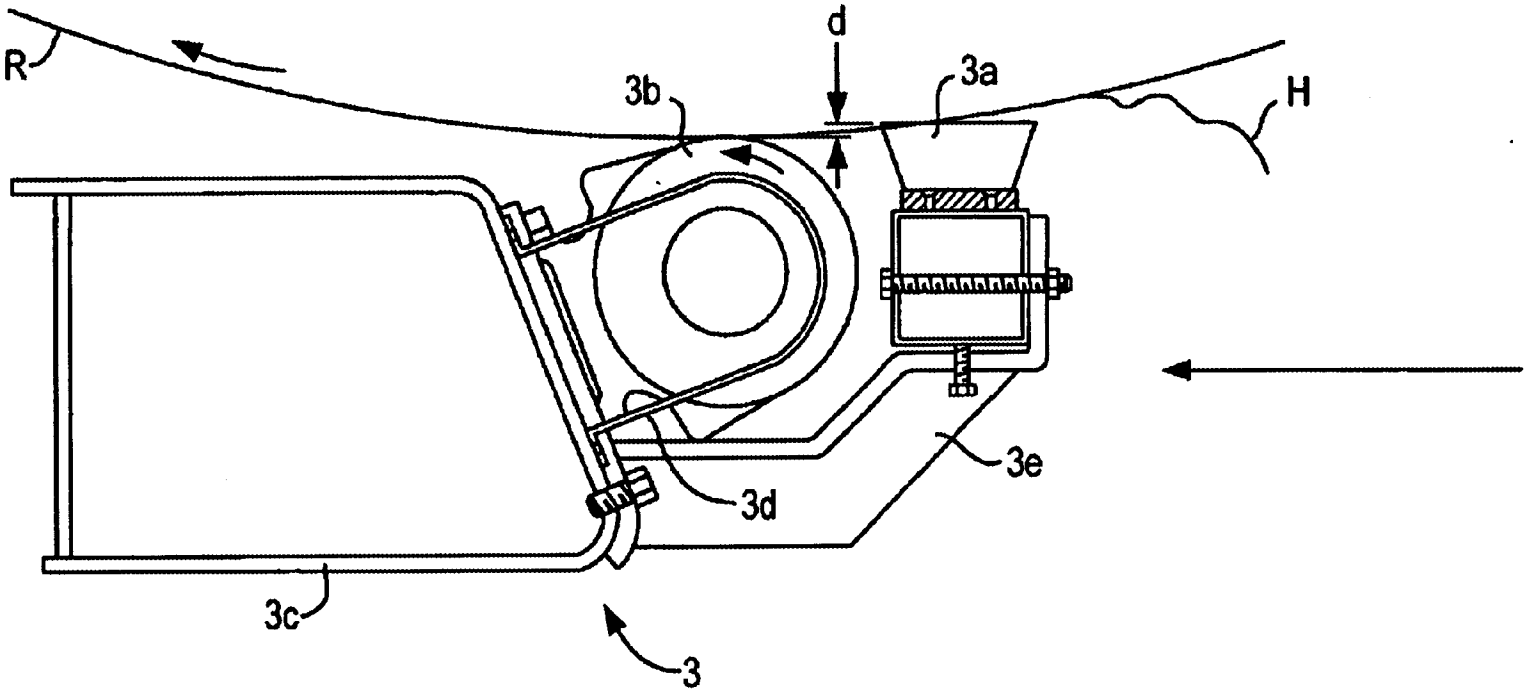
FIG. 3 illustrates the larger scale.

FIG. 3 shows the press device 3 in a more detailed manner. The guiding member 3*a* is attached to the same frame 3*c* as the press roll 3*b* which is arranged rotatable. The frame can be transferred e.g. along guides in the machine direction. As can be seen in the drawing, the control member is a brush formed of bristles, which is in contact with the peripheral surface of the reel R, thus wiping the surface of the reel when the reel is rotating. The press roll 3*b* is utilized for attaining the loading necessary for binding the surface layers together. If there were no guiding member 3*a* before the press roll 3*b*, the tail H of the paper web would make a movement resembling a whiplash onto the surface of the roll 3*b*, and it would be broken into pieces, which the roll then would press against the surface of the reel. Now, in the situation shown in FIG. 3, the guiding member 3*a* prevents the pieces of paper possibly loosening from the web from being conveyed between the roll and the reel. The pieces possibly loosening from the tail remain in the guiding member 3*a* and drop down therefrom, wherein they can be easily guided for example to a pulper, which is below the reel-up.

Figure 4:
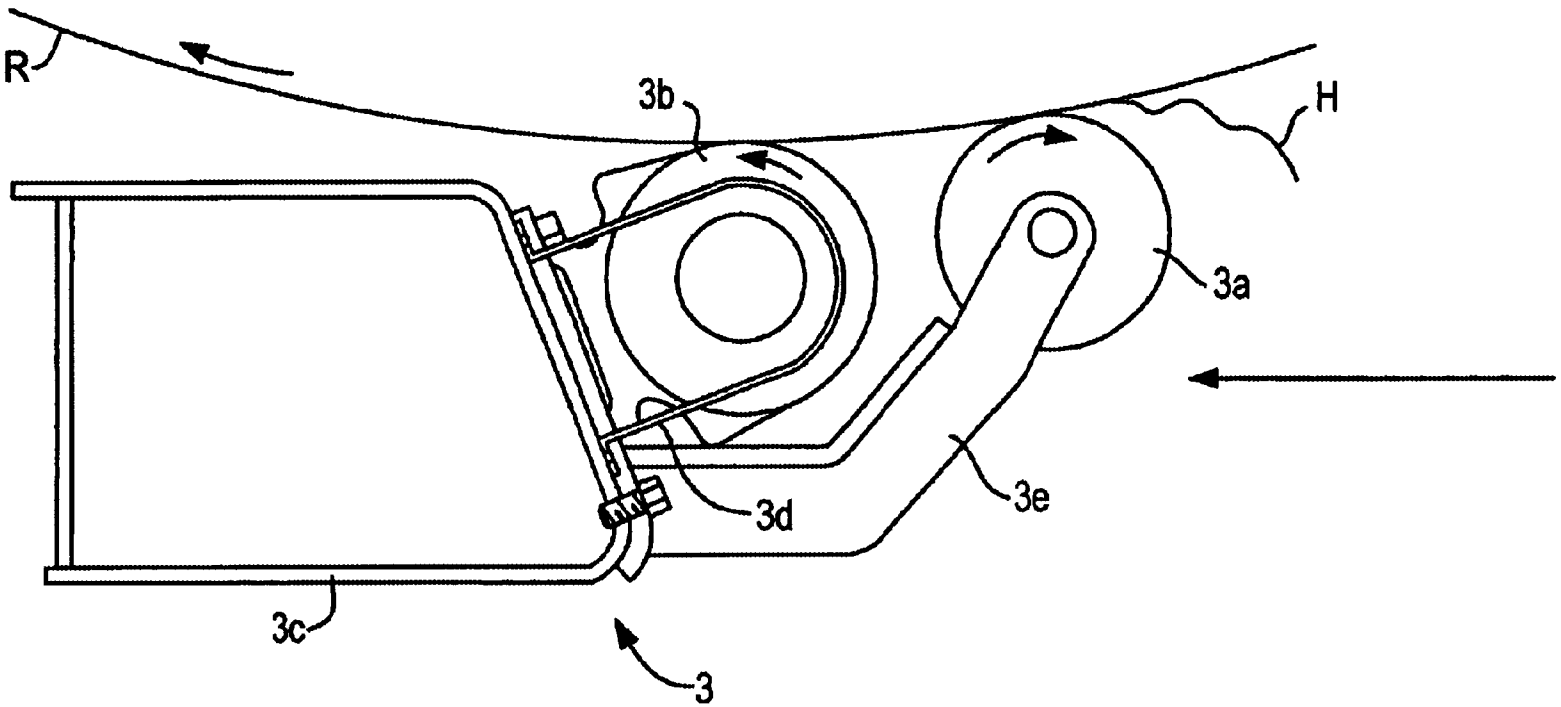
FIG. 4 illustrates another embodiment of FIG. 3.

The parallel surface speed of the surface of the guiding member 3*a* opposite to the reel and of the peripheral surface of the reel differ substantially from each other. Thus, there is a relative speed difference between the peripheral surface of the web and the surface of the guiding member opposite to the same. The speed difference is such that the speed of the surface of the guiding member 3*a* in the direction of the peripheral surface of the reel is clearly lower than the surface speed of the reel. The speed difference can be attained by arranging the guiding member 3*a* static, i.e. stationary, as the brush shown in FIG. 3, wherein the speed of the surface of the guiding member 3*a* with respect to the peripheral speed of the reel in the direction of travel of the peripheral surface of the reel is −v1, where v1 is the surface speed of the peripheral surface of the reel. Another possibility to attain the speed difference is to arrange the guiding member 3*a* rotatable in such a manner that it has the same direction of rotation as the reel R, as shown in FIG. 4 wherein the surface of the guiding member 3*a* that is closest to the peripheral surface of the reel moves in a direction opposite to that of the peripheral surface of the reel R. If the surface speed of the guiding member is v2, the relative surface speed of the guiding member 3*a* with respect to the peripheral surface of the reel R is −(v1+v2). If the surface of the guiding member 3*a* is arranged to move in the same direction in which the peripheral surface of the reel moves at a lower surface speed v2 than the peripheral surface of the reel in the point closest to the reel, the relative surface speed of the guiding member 3*a* with respect to the peripheral surface of the reel R is thus −v1+v2. All the aforementioned cases cause the "dragging" of the surface of the guiding member 3*a* against the peripheral surface of the reel R and/or against the tail H of the web.

The surface of the guiding member 3*a* opposite to the peripheral surface of the reel R is arranged elastic in such a manner that it can be pressed against the surface of the reel within a particular distance, and it can also conform to the variations in the diameter of the reel. Thus, the position of the guiding member 3*a* with respect to the reel R does not have to be adjusted accurately. To implement the yielding surface, the guiding member 3*a* may be provided with bristles, but also with other types of flexible members, which wipe the surface layers of the reel R and/or the tail H. The guiding member 3*a* may be provided with flexible strips or the like, extending in the transverse direction of the machine, i.e. in the direction of the reel axis, forming a sort of a doctor blade. Such flexible members, e.g. bristles, strips or the like guide the loose tail H softly on the surface of the reel, and because of the slower surface speed, release the pieces possibly loosening from the tail in the impact of its end. It is also possible that the static guiding member only has one transverse strip against the perimeter of the reel or in the vicinity of the same, within a particular width lying against the peripheral surface of the reel and/or guiding the tail H.

If the guiding member 3*a* is a rotating guiding member, its surface can also be formed of bristles, wherein it is a kind of a brush roll wiping the surface of the reel, or of strips transverse to the machine direction, the strips also wiping the surface of the reel, wherein it is a kind of a strip-faced roll.

The surface structure of the guiding member 3*a* can also be a uniform compressible structure, and it can, for example, be the surface of a sponge-like body.

FIG. 3 shows how the surface of the guiding member 3*a* touches the peripheral surface of the reel R. The touch is then a light touch in such a manner that the yielding surface of the member 3*a* has been pushed a short distance (distance d) against the peripheral surface of the reel. According to FIG. 3, the rear part of the surface of the brush is within a particular distance in a light contact with the peripheral surface of the reel.

Another alternative is a contactless guidance, in which the surface of the guiding member 3*a* is not in contact with the outer surface layer of the compact reel R, but rather in contact with the tail H formed of the final end of the web, thus guiding the tail closer to the web. The distance from the outermost surface layer of the reel is in this case small, advantageously under 10 mm. The guiding member 3*a* within a small distance from the peripheral surface of the web is also capable of preventing the entrance of the small pieces loosened from the tail between the press roll 3*b* and the reel R.

The guiding member 3*a* is most advantageously located before the press roll 3*b* in the direction of rotation, wherein it first receives the loose tail H coming in the direction of the perimeter of the reel. It is, however, possible that the guiding member 3*a* is within a short distance from the press roll 3*b* after the same, wherein it is in a sufficiently fight contact with the surface of the web in such a manner that it is capable of wiping off the pieces of paper passed through the nip between the reel and the press roll 3*b* from the surface of the reel. The surface structure and the motion (static/rotating) of the guiding member 3*a* can be arranged according to the description above.

The guiding member 3*a* can also be a relatively rigid member which is directed against the direction of rotation of the reel and located before the press roll 3*b* in the direction of the perimeter of the reel, and it is spaced within a short distance (e.g. under 20 mm) from the peripheral surface of the reel, wherein the purpose of the same is to receive and cut the loose end of the tail H which is farther away from the reel than the positioning distance of the member, and to guide the tail preceding the loose end towards the nip between the press roll 3*b* and the reel R. Such a member can taper off against the direction of rotation of the web, and it can be formed as a sharp-edged cutting blade.

The guiding member 3*a* and the press roll 3*b* are advantageously arranged to a common frame 3*c* to be moved in the machine direction with respect to the reel R and together with the motion of the reel, in either one of the above described orders. Thus, the distance between the press roll 3*b* and the guiding member 3*a* can also be arranged to be suitably small in view of their good co-operation. As can be seen in FIG. 3, the press roll 3*b* can be journalled rotatably on brackets 3d protruding from the frame, and the guiding member can be mounted to an arm 3*e* protruding from the frame. A suitable loading and location of the guiding member 3*a* with respect to the peripheral surface of the reel can be attained by running the press device 3 sufficiently far underneath the reel R from the incoming direction of the web W. The loading of the press roll 3*b* can also be adjustable by means of actuators arranged in the press device, and the position of the guiding member 3*a* can also be adjusted e.g. B changing the position of the arm 3*e* supporting the same. This adjustment can also be made manually before the press device is run in contact with the reel R, or the position of the guiding member 3*a* can be adjustable by means of suitable actuators when the press device 3 is in its operating position in connection with the reel.

The guiding member 3*a* advantageously extends over the entire width of the web. The control member can also extend only over a part of the width of the web for example at points where the tail H is at its longest. Thus, it can be only within an area of particular width on both edges in cases where sections which are especially long remain in the reel on said edges in gooseneck changes or corresponding change methods, in which the web is first torn from the middle. The press roll 3*b* advantageously extends over the entire width of the reel R.

What is claimed is:

1. A Method in connection with a reel-up of a paper web provided with a rotating reel spool (2) around which a reel (R) has been formed from the paper web (W) passed to the reel-up, wherein in the method the web (W) passed to the reel is cut, and the surface layers of the reel are bound by means of a press device (3) which is in contact with the surface of the rotating reel (R) and comprises a press member (3*b*) forming a nip with the peripheral surface of the reel and rotating substantially at the same surface speed therewith, wherein in addition to using the press member (3*b*), the final end, i.e. tail (H) of the web that travels along with the rotating motion of the reel, is guided against the peripheral surface of the reel (R) by means of a guiding member (3*a*), which is located within a -distance from the press member (3*b*) in the direction of the perimeter of the reel before the press member (3*b*) in the direction of rotation of the reel and whose surface that is located opposite to the reel has a lower speed in the direction of motion of the peripheral surface of the reel (R) than the peripheral surface of the reel (R) and the guiding member (3*a*) is located under the angular distance of 30° from the press member.

2. The method according to claim 1, wherein the guiding member (3*a*) is a static member whose surface that is in contact with the tail (H) and/or the peripheral surface of the reel (R) is stationary.

3. The method according to claim 1, wherein the guiding member (3*a*) is a rotating guiding member.

4. The method according to claim 1, wherein the surface of the guiding member (3*a*) that is in contact with the tail (H) and/or the peripheral surface of the reel (R) is elastic.

5. The method according to claim 4, wherein the guiding member (3*a*) comprises at least one flexible members in contact with the tail (H) and/or the peripheral surface of the reel (R).

6. The method according to claim 5, wherein the guiding member (3*a*) comprises bristles, which are in contact with the tail (H) and/or the peripheral surface of the reel (R).

7. A device in connection with a reel-up of a paper web, comprising a rotating reel spool (2) and around the same a reel (R) formed from the paper web (W) passed to the reel-up, wherein the device can be arranged in contact with the surface of the rotating reel (R), said device comprising a press member (3*b*) forming a nip with the peripheral surface of the reel and rotating substantially at the same surface speed therewith, wherein in addition to the press member (3*b*), the device comprises a guiding member (3*a*), separate from the press member (3*b*), which can be transferred in the operating position adjacent to the peripheral surface of the reel or in contact with the same to guide the final free end of the web, i.e. a tail (H) moving along with the rotating motion of the reel, against the peripheral surface of the reel (R), wherein the guiding member (3*a*) is in the operating position within a distance from the press member (3*b*) in the direction of the perimeter of the reel and is in contact with the tail (H) and/or with the peripheral surface of the reel (R) before the press member (3*b*) in the direction of rotation of the reel and the surface of the guiding member (3*a*) that is located opposite to the reel is arranged to have a lower speed in the direction of motion of the peripheral surface of the reel (R) than the peripheral surface of the reel (R) and the guiding member 3(*a*) is located under the angular distance of 30° from the press member.

8. The device according to claim 7, wherein the guiding member (3*a*) is a static member whose surface that is in contact with the tail (H) and/or the peripheral surface of the reel (R) is stationary.

9. The device according to claim 7, wherein the guiding member (3*a*) is arranged rotatable in its operating position.

10. The device according to any of the foregoing claims 7 to 9, wherein the guiding member (3*a*) has an elastic surface which can be arranged in contact with the tail (H) and/or the peripheral surface of the reel (R).

11. The device according to claim 10, wherein the guiding member (3*a*) comprises at least one flexible members, which can be arranged in contact with the tail (H) and/or the peripheral surface of the reel (R).

12. The device according to claim 11, wherein the guiding member (3*a*) comprises bristles, which can be arranged in contact with the tail (H) and/or the peripheral surface of the reel (R).

13. The device according to claim 7, wherein the guiding member (3*a*) is in contact with the tail (H) and/or with the peripheral surface of the reel (R) is under the angular distance of 30° from the press member (3*b*).

14. The device according to claim 7, wherein the guiding member (3*a*) and the press member (3*b*) are fixed to a common frame (3*c*) which can be transferred to the operating position in connection with the reel (R).

15. The device according to claim 14, wherein the position of the guiding member (3*a*) with respect to the frame (3*c*) is adjustable.

16. A method in connection with a reel-up of a paper web, comprising the steps of:

rotating a reel spool (2) around which a reel has been formed from the paper web (W) passed to the reel-up;

cutting the web (W) passed to the reel;

bounding a surface layer of the reel by means of a press device(3) having a press roll (3*b*), said press device (3) is in contact with the surface of the rotating reel;

forming a nip with the peripheral surface of the reel by loading the press roll proximate with the surface of the reel and rotating the press roll substantially at the same surface speed as the reel;

guiding a final tail end (H) of the web, that travels along with the rotating motion of the reel, against the peripheral surface of the reel by means of a guiding member (3*a*), said guiding member (3*a*) arranged in a distance from the press member (3*b*) in the direction of the perimeter of the reel, said guiding member surface in the direction of the peripheral surface of the reel, arranged opposite to the reel, having a lower speed than a surface speed of the reel and being located before the press member (3*b*) in the direction of rotation of the reel at an angular distance of less than 30°.

17. The method according to claim 16, wherein the guiding member (3*a*) is a static member, said surface of said guiding member is arranged proximate to the tail (H) and/or the peripheral surface of the reel (R) is stationary.

18. The method according to claim 16, wherein the guiding member (3*a*) is a rotating guiding member.

19. The method according to claim 16, wherein the surface of the guiding member (3*a*) that is arranged proximate to the tail (H) and/or the peripheral surface of the reel (R) is elastic.

20. The method according to claim 19, wherein the guiding member (3*a*) has at least one flexible members arranged proximate to the tail (H) and/or the peripheral surface of the reel (R).

21. The method according to claim 20, wherein the guiding member (3*a*) has a plurality of bristles, said bristles are arranged proximate to the tail (H) and/or the peripheral surface of the (R).

* * * * *